United States Patent [19]

Seidler

[11] 4,139,256

[45] Feb. 13, 1979

[54] ELECTRICAL CONTACT AND METHOD OF MAKING SAME

[75] Inventor: Jack Seidler, New Rochelle, N.Y.

[73] Assignee: North American Specialties Corp., Flushing, N.Y.

[21] Appl. No.: 833,662

[22] Filed: Sep. 15, 1977

[51] Int. Cl.[2] ..... H01R 13/12

[52] U.S. Cl. ..... 339/258 R; 113/119

[58] Field of Search ..... 339/256 R, 258 R, 258 A, 339/258 P; 113/119

[56] References Cited

U.S. PATENT DOCUMENTS

| | | | |
|---|---|---|---|
| 1,194,122 | 8/1916 | Ball | 339/258 R |
| 3,538,491 | 11/1970 | Longenecker et al. | 339/256 R |
| 3,544,954 | 10/1968 | Yeager | 339/258 R |
| 3,654,595 | 4/1972 | Curr | 339/256 R |
| 4,068,917 | 1/1978 | Seidler | 339/258 R |

*Primary Examiner*—Joseph H. McGlynn

*Attorney, Agent, or Firm*—DeLio and Montgomery

[57] ABSTRACT

An electrical contact with a cylindrical bore having an internal pressure finger and two external retaining louvers, made from a blank of sheet metal wherein the outlines of each finger and louver are stamped as U-shaped cuts spaced in separate rows, the blank then being folded along a line between the respective rows and rolled into cylindrical form with the pressure finger on the inside and retaining louvers on the outside.

7 Claims, 10 Drawing Figures

ELECTRICAL CONTACT AND METHOD OF MAKING SAME

This invention relates to a cylindrical female electrical contact having an internal pressure finger and two external retaining louvers, and the method of making such a contact by stamping the outlines of the finger and louver in a flat blank, folding the blank on a line between the respective outlines and rolling each blank into cylindrical form.

In the manufacture of cylindrical contacts it is customary to cut the pressure finger from an area of the cylindrical wall such that a retaining louver cannot readily be provided in or near the same area. This may lead to the provision of only a single louver which reduces security and represents an inferior design. A pressure finger so formed has no protection against being over-deflected, which is undesirable.

It is accordingly an object of the present invention to provide an electrical contact wherein each pressure finger and a pair of retaining louvers can be stamped from spaced areas of a flat blank and thereafter brought into proper juxtaposition by a single fold of the blank, followed by rolling the folded blank into its desired cylindrical shape.

It is another object of the invention to provide a contact wherein the entering edge of the cylindrical opening is a folded edge, facilitating insertion of the mating male contact.

It is a further object of the invention to provide a method of making such contacts wherein the orientation of the pressure finger and retaining louvers can readily be varied to suit special requirements.

It is yet another object of the invention to provide certain improvements in the form, construction and arrangement of the several parts, and the steps of the method, whereby the above-named and other objects may effectively be attained.

The invention accordingly comprises the several steps and the relation of one or more of such steps with respect to each of the others, and the article possessing the features, properties and the relation of elements, which are exemplified in the following detailed disclosure, and the scope of the invention will be indicated in the claims.

Practical embodiments of the invention are shown in the accompanying drawings, all on an enlarged scale and showing only the pertinent end portion of the blank and/or contact, wherein.

Figure 1:
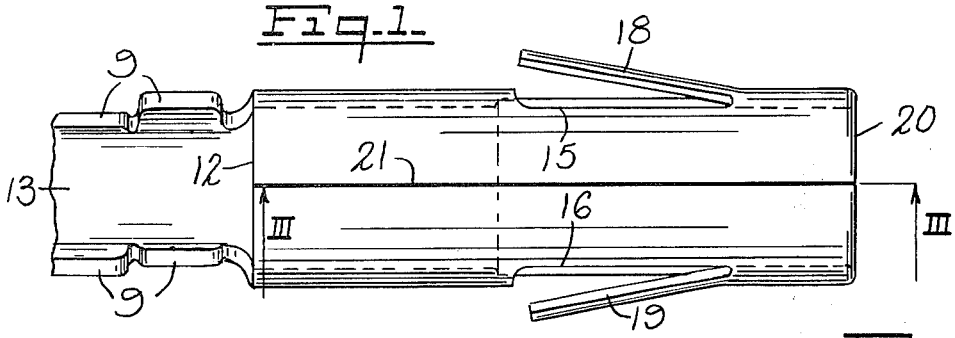
FIG. 1 represents an elevation of a first form of contact.
Figure 3:
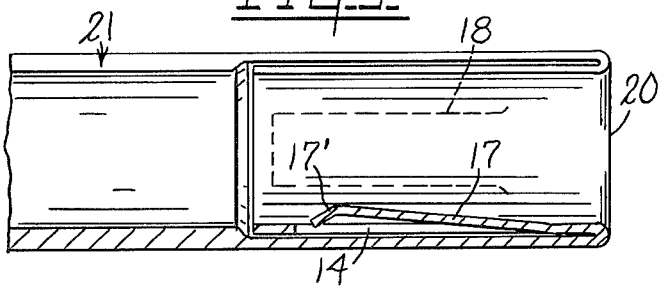
FIG. 3 represents an axial section on the line III—III of FIG. 1.
Figure 2:
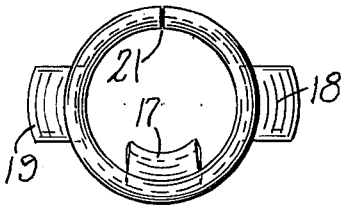
FIG. 2 represents an end view of the contact, viewed from the right of FIG. 1.
Figure 4:
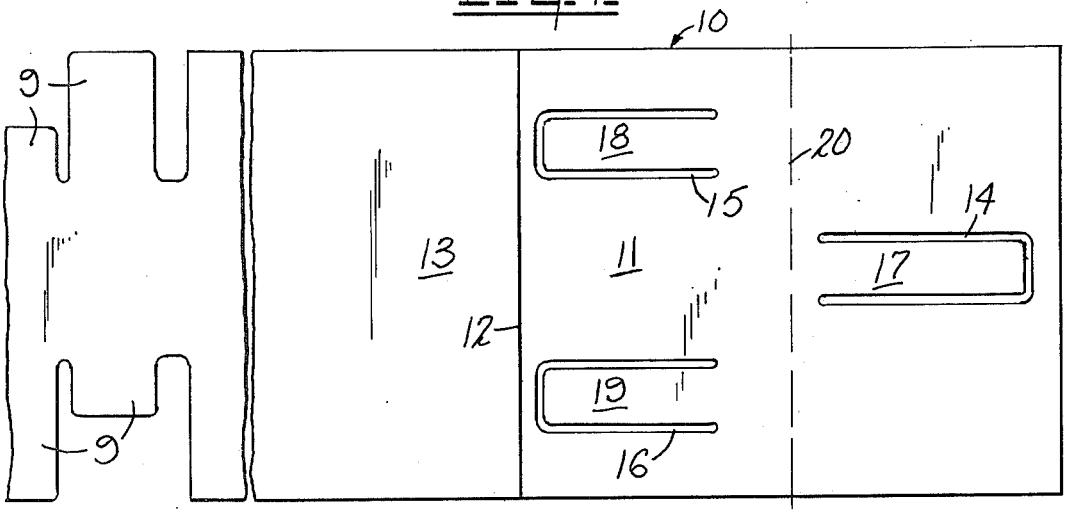
FIG. 4 represents a plan view of the blank used to make the contact of FIGS. 1 to 3.

Referring to the drawing, and particularly FIGS. 1 to 4, the flat conductive metal blank 10, shown in FIG. 4, represents the end of a strip, the left end of which is normally provided with elements (represented by the tabs 9) facilitating connection to a conductor, while initially being part of a carrier strip such that a multiplicity of contacts can be stamped and formed rapidly and efficiently. The present description will refer to a single contact, with the understanding that such a contact is seldom alone.

While a blank having uniform thickness throughout could be used, it is preferable to provide, for each of the contacts shown herein, a blank wherein the folded portion is thinner than the portion which is only rolled. In the blank 10 the portion 11, beyond the line 12, is thinner than the base portion 13, as clearly shown in FIG. 3. To make the contact of FIG. 1, the blank is stamped to form three U-shaped cuts, 14, 15 and 16 which define, respectively, the pressure finger 17 and retaining louvers 18 and 19. The thin portion 11 is then folded along the line 20 which divides the portion into a pressure finger zone and a louver zone, and the blank is rolled into cylindrical shape, with the folded end on the inside, the pressure finger 17 being bent slightly inward and recurved outward near its free end as indicated at 17'. The retaining louvers 18 and 19 are bent outward in position to engage a support or housing, as is customary. The seam 21 where the edges of the folded and rolled blank touch each other may be welded, brazed or soldered for increased stability.

The orientation of the pressure finger and retaining louvers is a matter of choice with the user, depending somewhat on the intended manner of use. The modifications shown in FIGS. 5 to 10 represent three possible combinations of orientation.

Figure 5:
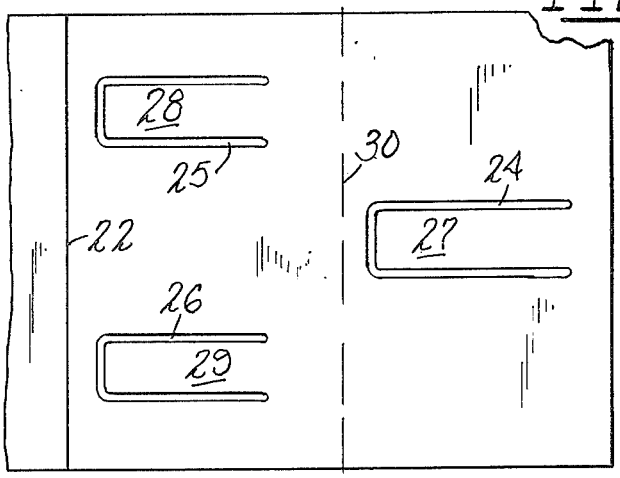
FIG. 5 represents a plan view of the blank used to make a second form of contact.
Figure 6:
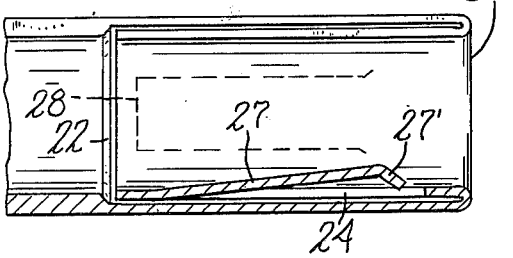
FIG. 6 represents an axial section, like FIG. 3, of the contact made by the use of a blank as shown in FIG. 5.

FIGS. 5 and 6 illustrate a blank wherein the U-shaped cut 24 is turned 180° from the position of cut 14 in FIG. 4 thus forming a pressure finger 27 having its free end 27' adjacent the folded edge 30. The cuts 25 and 26 are the same as cuts 15 and 16, forming retaining louvers 28,29 exactly like the louvers 18,19 of FIGS. 1 to 4 and the line 22 indicates where the blank thickness is reduced.

Figure 7:
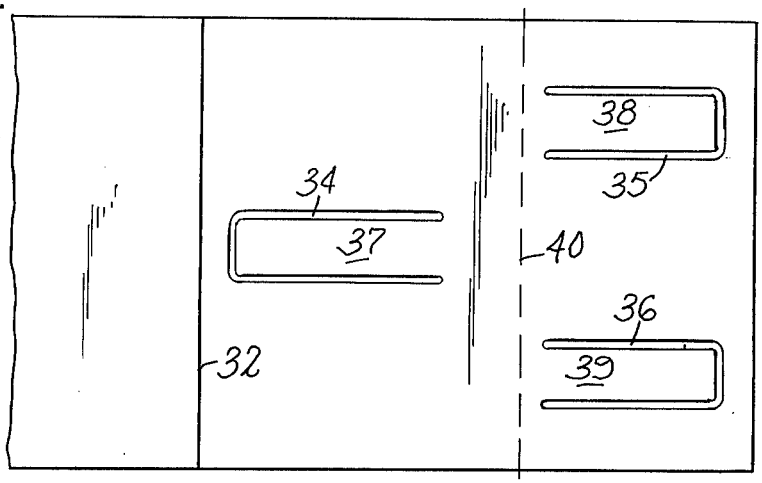
FIG. 7 represents a plan view of the blank used to make a third form of contact.
Figure 8:
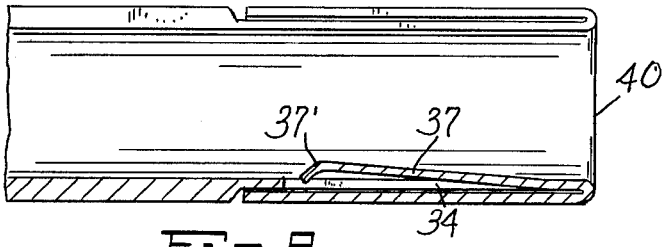
FIG. 8 represents an axial section, like FIGS. 3 and 6 of the contact made by the use of a blank as shown in FIG. 7.

In FIGS. 7 and 8 the U-shaped cut 34 is made in the portion of the blank between the line 32, where the thickness change occurs and the fold line 40, forming a pressure finger 37 having its free end 37' near the line 32. The cuts 35 and 36 are made in the portion of the blank adjacent its free end, to form retaining louvers and the blank is folded outward and rolled, as shown in FIG. 8, to place the finger 37 on the inside and the louvers 38,39 on the outside. The product so formed is the same as that shown in FIGS. 1 to 4 except that the thinned and stamped portion of the blank is folded outward instead of inward.

Figure 9:
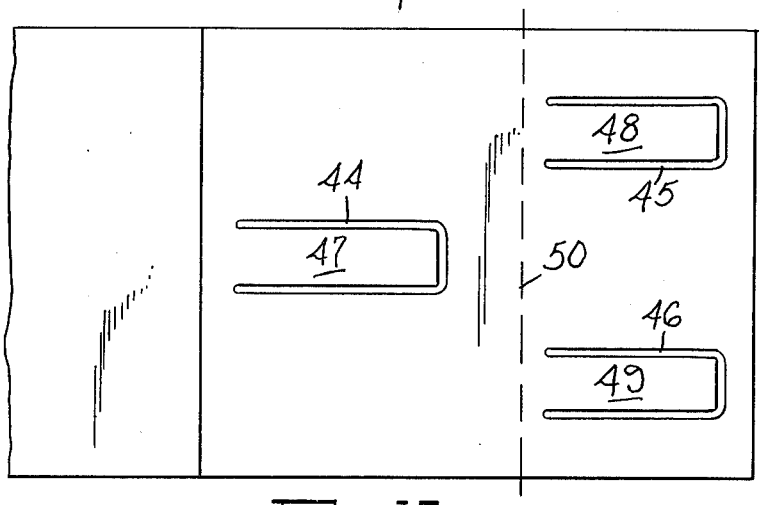
FIG. 9 represents a plan view of the blank used to make a fourth form of contact.
Figure 10:
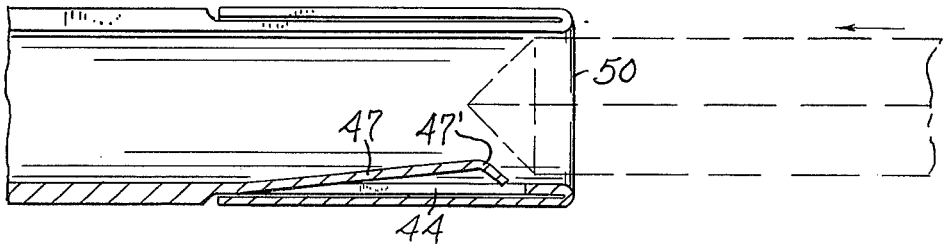
FIG. 10 represents an axial section, like FIGS. 3, 6 and 8 of the contact made by the use of a blank as shown in FIG. 9.

According to FIGS. 9 and 10, the retaining louvers 48,49 are formed by cuts 45,46 between the fold line 50 and the end of the blank, exactly as in FIGS. 7 and 8. The cut 44 is reversed, however, to form a finger 47 having its recurved free end 47' adjacent the fold line. When the portion containing the louvers 48,49 is folded outward and rolled to place the finger 47 on the inside, the product corresponds to that shown in FIGS. 5 and 6 except for the direction of the fold.

The conductive strip used for the blanks may typically have a thickness of 0.33 to 0.38mm. and thinning of the portion to be stamped and folded is conveniently effected by milling.

While contacts having a single pressure finger and two retaining louvers are shown and described, it will be understood that a plurality of pressure fingers could be provided, in any desired circumferential distribution and either aligned with the retaining louvers or partially or entirely offset therefrom. Such flexibility in distribution results from the use of different zones for the pressure fingers and the louvers, forming two layers when folded; it would obviously be unobtainable in a cylinder having only a single layer of material. In such latter devices it is sometimes found difficult or impossible to provide more than a single retaining louver, particularly if two pressure fingers are formed, which may result in inadequate retention. Another advantage which is inherent in the folded construction is that the pressure finger is provided with anti-overstress protection in that its recurved end, such as 17', 27', 37' or 47' is backed by the inner surface of the zone from which the retaining louvers are cut, in all arrangements except where the finger might, for any reason, be aligned with a louver.

The contacts shown herein are cylindrical, with circular cross-sections, but it will be appreciated that the cross-sectional form could be oval, square, triangular, or other form, if desired, with the pressure fingers and louvers distributed in any preferred manner. Reference to a "cylindrical" bore is to be interpreted broadly unless otherwise indicated.

It will thus be seen that the objects set forth above, among those made apparent from the preceding description, are efficiently attained and, since certain changes may be made in carrying out the above method and in the article set forth without departing from the spirit and scope of the invention, it is intended that all matter contained in the above description and shown in the accompanying drawing shall be interpreted as illustrative and not in a limiting sense.

What I claim is:

1. A one-piece electrical contact having a cylindrical bore comprising, at the entrance end of the bore, a two-layer annular zone of conductive material terminating in a folded edge extending around substantially the entire circumference of said entrance end, at least one pressure finger being integral with the inner layer.

2. An electrical contact according to claim 1 which includes a plurality of pressure fingers integral with the inner layer.

3. An electrical contact according to claim 1 which includes at least one retaining louver integral with the outer layer.

4. An electrical contact according to claim 3 which includes a plurality of retaining louvers integral with the outer layer.

5. An electrical contact according to claim 3 wherein no pressure finger is opposite a retaining louver.

6. An electrical contact according to claim 1 which includes a single-layer body portion of conductive material, the thickness of said body portion being greater than the thickness of either layer in the two-layer zone.

7. An electrical contact according to claim 6 wherein the thickness of the body portion is substantially equal to the thickness of the two-layer zone.

* * * * *